US005132657A

United States Patent [19]

Taylor et al.

[11] Patent Number: 5,132,657

[45] Date of Patent: Jul. 21, 1992

[54] TEMPERATURE LIMITING CONTROL FOR AN ELECTRIC HEATING DEVICE

[75] Inventors: John C. Taylor, Arbory; Vincent J. Garvey, Port Erin; Richard B. Brown, Colby, all of United Kingdom

[73] Assignee: Strix Limited, United Kingdom

[21] Appl. No.: 654,500

[22] Filed: Feb. 13, 1991

[30] Foreign Application Priority Data

Feb. 13, 1990 [GB] United Kingdom ..... 9003209

[51] Int. Cl.[5] ..... H01H 37/04; H01H 37/52

[52] U.S. Cl. ..... 337/382; 219/449

[58] Field of Search ..... 337/392, 391, 382, 390; 219/449, 464

[56] References Cited

U.S. PATENT DOCUMENTS 2,154,043 4/1939 Gough ..... 219/25
3,710,076 1/1973 Frazier ..... 219/449
3,723,935 3/1973 Frazier .
4,754,253 6/1988 Slack et al. ..... 337/392

FOREIGN PATENT DOCUMENTS 0279368 8/1988 European Pat. Off. .
2103638 8/1972 Fed. Rep. of Germany .
3100758 9/1982 Fed. Rep. of Germany .

*Primary Examiner*—Harold Broome
*Attorney, Agent, or Firm*—Bacon & Thomas

[57] ABSTRACT

A temperature limiting control for an electrical heating appliance such as a ceramic hob comprises switch means (11) and a temperature sensor (10) connnected thereto. The temperature sensor comprises an elongate reference member (12) of ceramic or other low expansion material and an elongate expansion member (13), for example a tape of high chrome steel, relative expansion of the two members operating the switch. The switch (11) and reference member (13) lie to one side of the expansion member (12) so that the latter may be placed closely adjacent the top (2) of the appliance.

18 Claims, 4 Drawing Sheets

TEMPERATURE LIMITING CONTROL FOR AN ELECTRIC HEATING DEVICE

The present invention relates to a temperature limiting control for an electric heating device and in particular, but not exclusively, to a temperature limiting control for a cooking appliance having a heat transmitting top for supporting and heating a cooking utensil. Such appliances typically have a smooth top of a glass ceramic, and a radiant or infra-red heating element arranged below and spaced from the lower surface of the top for supplying heat. Under certain operating circumstances the top may overheat, and it is therefore usual to include a temperature limiting control which de-activates the heating element when a certain predetermined safe maximum temperature of the top is exceeded.

Such temperature limiting controls typically consist of a temperature sensor for sensing the temperature of the appliance top in the form of an elongate rod of high expansion metal which is enclosed within a transparent silica glass reference tube, and a snap-action switch. The sensor is arranged in use parallel to the top and between the under surface of the top and the heating element, and relative movement of the rod and tube is used to operate the switch. The expansion rod is shielded from direct heating by radiation from the heating element as for example by being silver plated on its underside facing the heating element.

The expansion rod is displaced from the top surface at least by the thickness of the surrounding reference tube, and it will not therefore be able to sense the temperature of the top itself but rather it will sense the temperature of the environment some distance below the top, which will not be the same. Moreover the sensor is mounted centrally of the switch housing and since the switch is normally also located under the appliance top, the sensor and hence the expansion rod is displaced even further away from the under surface of the top whose temperature it is desired to sense.

According to the present invention there is provided a temperature limiting control for a cooking appliance having a heat transmitting top, including switch means and a temperature sensor comprising an elongate expansion member and an elongate reference member, the expansion member having a relatively high coefficient of thermal expansion as compared with that of the reference member, the relative movement of said members, in use, operating said switch means, said switch means and said elongate reference member lying wholly or substantially to one side of said expansion member whereby in use, the expansion member can be positioned in contact with or closely adjacent to the under surface of the appliance top.

Thus the reference member is arranged wholly or substantially to one side of the expansion member, rather than completely surrounding it as in the prior art. This asymmetrical arrangement facilitates the disposition of the switch means also to one side or substantially to one side of the expansion member. The expansion member may therefore be positioned closely adjacent to the under surface of the top and thus more accurately measure the temperature of the top. Indeed the control could be configured to permit the expansion member to be placed in contact with the under surface of the top although this would not normally be acceptable because of damaging mechanical shocks likely to be transmitted through the top to the control.

The reference member may be of any low expansion material, capable of withstanding the operating temperatures encountered. In practice, therefore, it is most likely to be a ceramic material. In the prior art where the expansion member is arranged within a transparent silica glass tube, it is usual to silver that part of the tube below the expansion member in order to reflect radiation emitted by the heating element below, better to sense the temperature of the appliance top. In the present invention however, since the low expansion reference member is arranged below the expansion member and does not come between the expansion member and the overlying appliance top, it does not need to be transparent. Accordingly, in a preferred embodiment the reference member is opaque to infra red or other heating frequencies with the result that it serves to shadow the expansion member from the heating element below. The shape of the reference member may be chosen so as to cast any desired pattern of shadow on the expansion member. Preferably, however, the reference member is wider than the expansion member along its length so as substantially to shadow the expansion member from the underlying heating elements. It is also possible that the underside of the expansion member itself could be silvered. Although it is conceivable that the reference member could for example be channel-shaped so as in use not only to lie below but also to either side of the expansion member, it is preferred that it lies wholly to one side of i.e., in use, beneath the expansion member.

Although the expansion member could be rigid, it is preferably flexible. Further the expansion member may be of any convenient cross-sectional shape, but, in a preferred arrangement, it is in the form of a tape or strip. Although other cross-sectional shapes can be envisaged, a strip or tape is particularly preferred since it presents a relatively large surface area and relatively small mass to be heated, and it is therefore particularly responsive to temperature changes in the appliance top. The tape may be formed from any suitable relatively high expansion material, such as a high chrome steel. Examples are Duratherm-Vacodil 20, Isaohm, Nirathal 40 and Hastalloy.

It is also possible to introduce sectional lengths of material of lower thermal expansion e.g. Invar, into the expansion member if it is desired to make certain sections or zones of the sensor less sensitive than others, as might be the case with asymmetric or irregular heating element configurations. When the expansion member is a non-rigid tape or the like, the rigidity and strength necessary for the sensor may be provided by the reference member which, since it lies below the expansion member may easily be given a relatively large cross-section.

Particularly when employing a non-rigid expansion member such as a tape the expansion member will normally be tensioned against the reference member. Conveniently one end of the expansion member may be fixed with respect to the reference member. For example, a slot in the tape may engage over a projection on the reference member, and biasing means will be provided at the other end of the expansion member. Preferably the biasing means is provided in the switch means. Means may be provided for initially adjusting and setting the tension in the expansion member. The adjustment and setting means may be provided at one or both ends of the expansion member.

As stated above, it is the relative movement of the expansion member and the reference member which operates the switch means. The switch means, may be of any convenient type for example a microswitch, and it is preferably a snap-action switch. A snap-action micro switch, such as an over-centre "C" spring type microswitch is particularly preferred.

A microswitch of this type typically comprises a fixed contact and two generally rectangular apertured leaf members which overlie one another and are joined to each other, by welding for example, or integral with each other at corresponding ends. One leaf, which is fixed at its other end, has a central limb, extending into the aperture from that end, which engages one end of a 'C' spring. The other end of the 'C' spring engages or is integral with the other leaf member which carries a movable contact. The arrangement is essentially a sprung over-centre snap-acting geometrical mechanism, with the 'C' spring acting to bias the leaf member carrying the contact towards or away from the other leaf member to make or break with a fixed contact depending on the relative positions of the 'C' spring and the leaf members. In use, an actuating force is applied to the joined ends of the leaves to cause operation of the microswitch.

In one embodiment, the microswitch may be mounted in a housing which is fixed with respect to one end of the reference member. The expansion member may be coupled directly to the microswitch member which then acts as a biasing means for tensioning the expansion member. As the temperature of the expansion member varies, the configuration of the microswitch will change and when it reaches the position where the spring passes centre, the switch will snap open to cut the power to the heating means.

In such an arrangement, it is normal for the movable switch contact to be provided on one of the leaf members. However, in a preferred embodiment of the present invention, the movable switch contact is provided remotely from the movable leaf member, which moves the contact through a push or pull rod. This has several advantages.

Firstly, it means that the leaf members of the microswitch need not be current carrying. This in turn means that they need not be welded together or formed from a single bent piece of metal, as is normally the case, but may instead be pivotally joined together for example by knife edge/groove pivots. Normally a pivoted joint between the leaf members would not be contemplated since they are current carrying, and it would not be possible to pass the relatively high currents (in the order of 10 Amps at least) through the pivot. In the welded or unitary construction, the natural resilience of the movable member acts against the 'C' spring. In a pivoting arrangement, this resistance is effectively removed resulting in improved contact pressures and pull apart forces in the switch.

In the remote contact arrangement, the movable contact is preferably carried on a leaf spring which normally biases the movable contact against a fixed contact, and which also mounts a pull or push rod which is acted upon by the movable leaf member. Preferably that end of the pull or push rod contacted by the movable leaf member is displaced from the movable leaf member, so that when the movable switch leaf trips, it strikes the pull or push rod with an impact force. This helps to break any welding which might have occurred between the switch contacts. Furthermore, by having the contacts remote from the movable switch member, wearing of the contacts does not affect the calibration of the switch.

In addition to having a switch which opens when the temperature of the appliance top exceeds a certain safe maximum say 650° C., there may also be a switch which closes at a lower temperature, say 60° C., to actuate a neon lamp or other warning device to show that the top is dangerous to touch. This switch can be of any convenient type and could also be a snap-action microswitch. This might be of either the known type referred to above, or the pivot-type switch described above. A pivot type switch would be suitable for use in such an application and could directly mount the movable switch contact since the current carried is only very small, in the region of 10 mA.

In a preferred embodiment the expansion member or tape is attached to a member which fits over the top of both the safety cut-out microswitch and the hot top warning microswitch.

A preferred embodiment of the invention will now be described, by way of example only, with reference to the following drawings in which.

Figure 1:
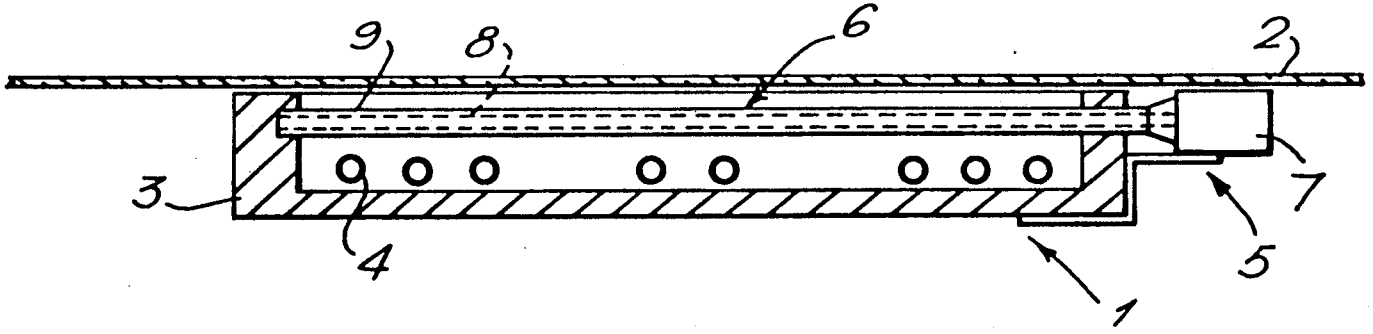
FIG. 1 PRIOR ART
FIG. 1 shows a prior art temperature limiting control in position under the smooth top of a cooking appliance.
Figure 2:
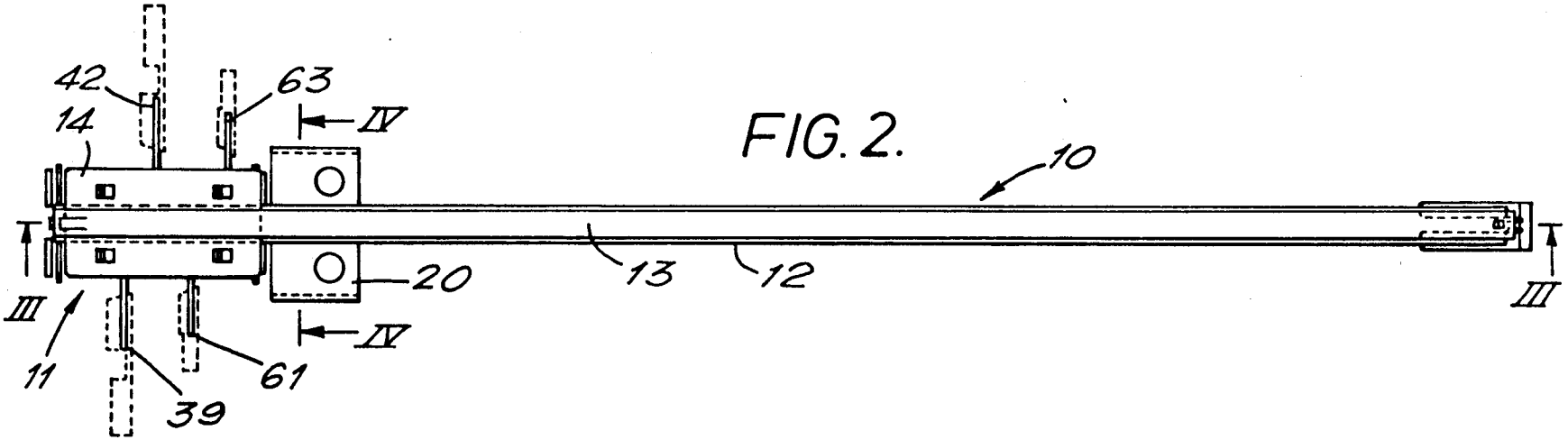
FIG. 2 shows a top view of an embodiment of the invention.

With reference to FIG. 1, a heating unit 1 is shown in position below the smooth top 2 of a cooking appliance. The top 2 is of a ceramic glass and supports a cooking utensil above the heating unit 1. The heating unit 1 comprises a housing 3 for mounting a heating element 4. This element 4 may be a radiant or infra-red element depending on the heating effect required. The housing 3 also mounts a prior art temperature limiting control 5 which functions to cut the power supply to the element 4 when the temperature of the top 2 exceeds a predetermined safe maximum, such as might occur if the heating unit 1 were left on without a utensil being positioned on the top 2. The temperature limiting control 5 comprises a sensor 6 and switch unit 7. Sensor 6 which senses the temperature of the top 2 comprises a high expansion rod 8 (shown in dotted lines) arranged inside a transparent quartz tube 9, and it is the relative movement of the rod 8 and tube 9 which operates the switch unit 7. As can be seen from the Figure, the sensor 6 is mounted centrally of the switch unit 7 which results in the sensor 6 being displaced a considerable distance from the top 2 under which the control 5 is mounted so that it cannot therefore, directly sense the temperature of the top 2.

A control according to the present invention can however be mounted much closer to the top 2 and thus give improved control. With reference to FIGS. 2 to 6, a preferred control embodying the present invention comprises a sensor 10 and switch unit 11. The sensor 10 consists of a pressed or extruded ceramic beam 12 which has a low coefficient of thermal expansion and acts as a reference member, and a expansion member in the form of a tape 13 of relatively high expansion material such as high chrome steel. The beam 12 is I-shaped i.e. waisted in cross-section. The tape 13 is connected at one end to the upper ends of microswitches of the switch unit 11 via a cap member 14 and at its other end to the ceramic beam 12 via an adjustment member 15 slidably mounted on that end of the ceramic beam 12. The tape 13 is provided with respective holes 16,17 which engage over respective tongues 18,19 formed on the cap member 14 and adjustment member 15.

Figure 3:
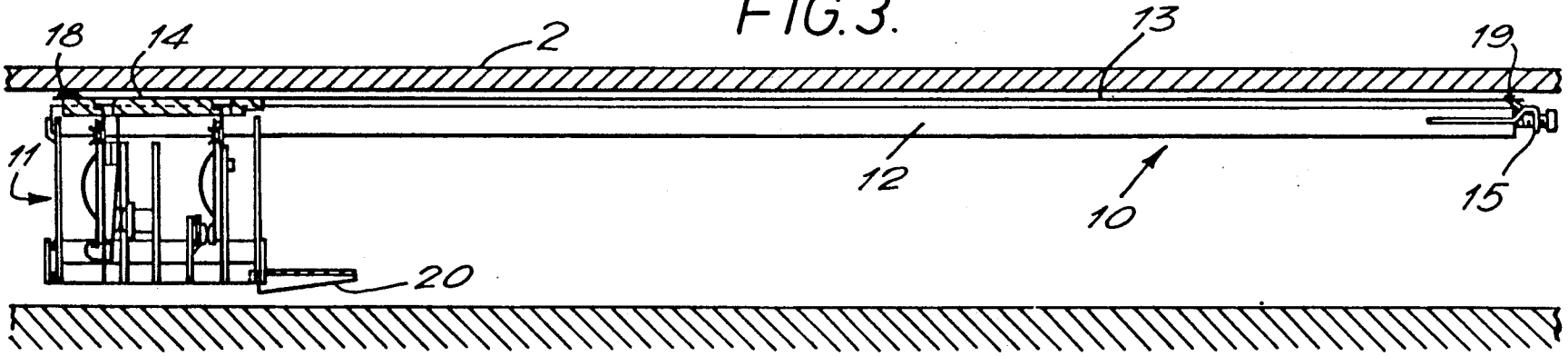
FIG. 3 shows a vertical longitudinal section through the control of FIG. 2.
Figure 4:
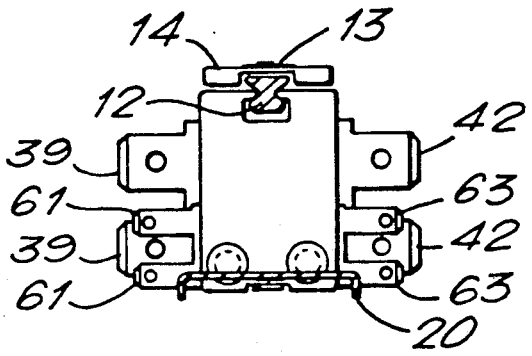
FIG. 4 shows a vertical, transverse section through the control of FIG. 2.

It will be seen from FIG. 3 that the ceramic beam 12 and the switch unit 11 are arranged below the tape 13 so that the tape 13 may be positioned in use closely adjacent but spaced from the under surface of the smooth top or hob 2 of a cooking appliance, which allows the tape 13 to more accurately sense the temperature of the top 2. It will be appreciated that the structure of the control described would permit the tape being positioned in contact with the under surface of the top 2. However this is not practicable in the embodiment described since the ceramic beam is brittle and must be isolated from shocks transmitted through the top 2 as can occur in practice if a cooking appliance is dropped onto the top.

The ceramic beam 12 which is in this embodiment opaque, substantially shadows the tape from the direct heating effect of heating element (4, FIG. 1) which will, in use, underlie it.

The ceramic beam 12 is mounted to the switch unit 11 at its end remote from the adjustment member 15 and extends over substantially the whole length of the switch unit 11.

The switch unit 11 comprises a mounting bracket 20 which in use is mounted on the housing of a heating unit, such as that shown in FIG. 1. A front plate 21 is fixed to the mounting bracket 20 and is provided at its upper end with a groove 22 for accepting the ceramic beam 12, and with holes 23 for assembly screws 24 and insulating sleeves 25. It is also provided with a further opening 26 to allow access to a calibration screw 27 as will be described later.

At the other end of the switch unit 11 there is provided a back plate 28, which has a groove 29 on its upper edge for accepting the ceramic beam 12, and a tongue 30 for locating the beam 12 axially. As can be seen from FIG. 6, the switch components lying between the front and back plates 21,28 are provided with holes to allow the passage of the assembly screws 24 and insulating sleeves 25 which extend through the switch unit 11 from the back plate 28 to the front plate 21, where they are secured by nuts (not shown). When the screws 24 are tightened, therefore the switch components are firmly clamped between the front plate 21 and back plate 28. Belleville washers 31 are provided to regulate the tightening force applied.

Within the switch unit 11 there are two microswitch assemblies 32,33. Microswitch assembly 32 acts to cut the power supply to the heating element when the temperature of the hob top exceeds a predetermined safe maximum value e.g. 650° C. and microswitch assembly 33 acts to light a neon or similar indicator (not shown) when the temperature of the hob top 2 reaches a temperature which is dangerous to the touch e.g 60° C.

Referring firstly to the cut-out microswitch assembly 32, this comprises a two-part snap-action actuator 35, a leaf spring member 36 carrying a movable contact 37, a tab plate 38 carrying tabs 39 for connection to one pole of a power supply, and a tab plate 40 carrying a fixed contact 41 and tabs 42 for connection to the other pole of the power supply. This may be the direct power supply to the heating element 4 or a relay for controlling such power supply. Apart from the leaf spring member 36 and the tab plate 38 which are in intimate contact with each other so that the movable contact 37 is in electrical connection with the power supply, the components are electrically isolated from each other by the insulating sleeves 25 and insulating spacers 34. Leaf spring member 36 biases the movable contact 37 into contact with the fixed contact 41.

The actuator 35 comprises a first generally W shaped leaf member 43 which is fixed in the component stack at its bottom end, and a second generally W shaped leaf member 44 which is pivotally mounted on the first leaf member 43.

Figure 5:
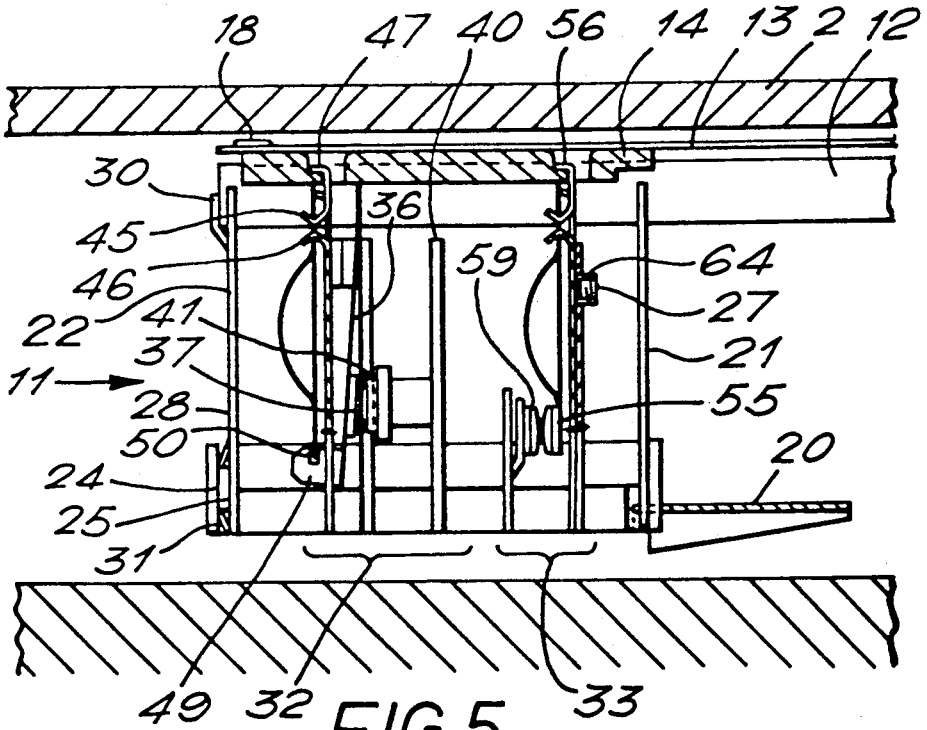
FIG. 5 shows the switch unit of the control of FIGS. 2 to 4 in more detail.
Figure 6:
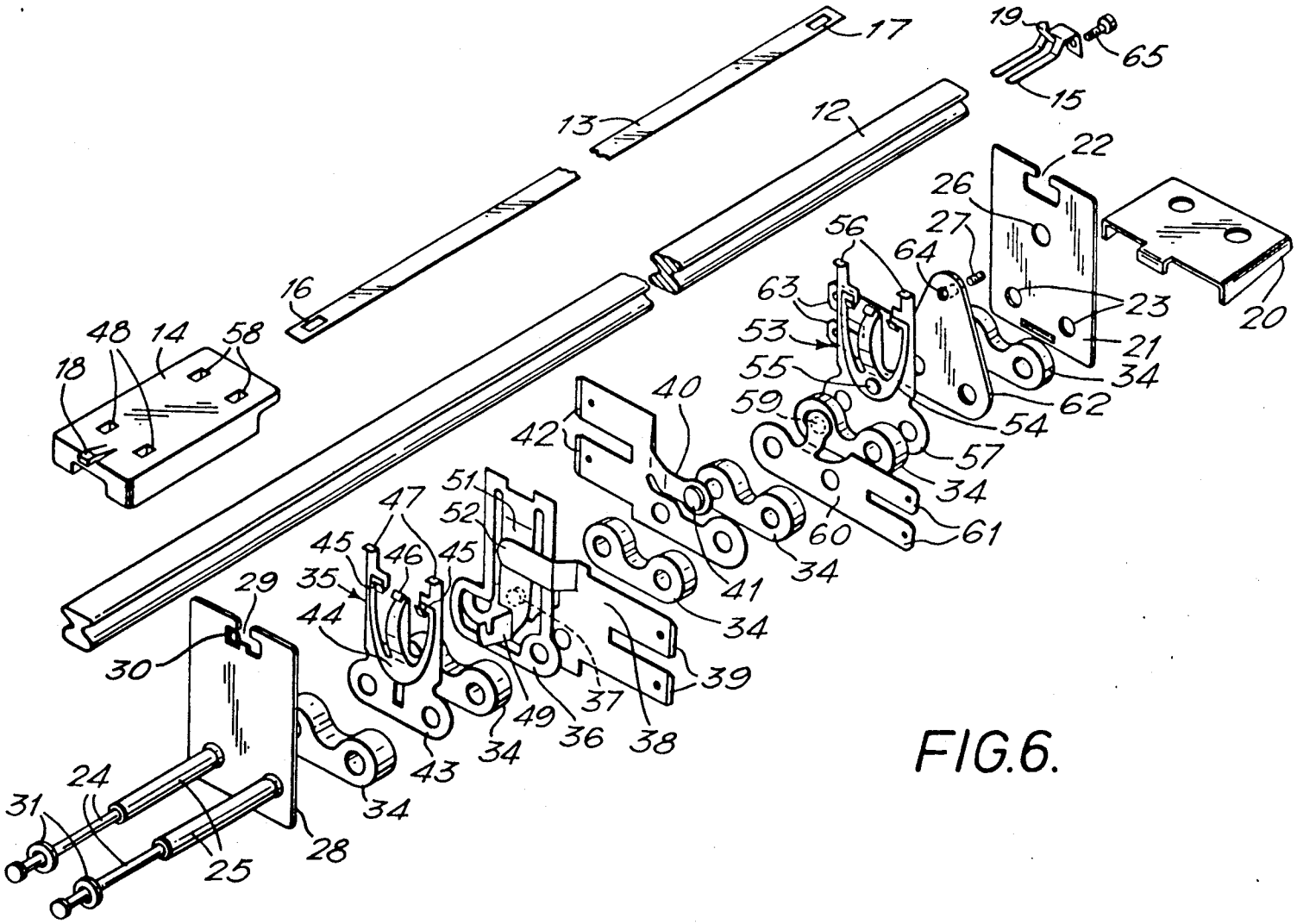
FIG. 6 shows an exploded view of the components of the switch unit.

The end regions of outer limbs of the first leaf member 43 are formed with upwardly open V grooves 45 and the end of the central limb of the first leaf member 43 is formed with a downwardly open V groove 46, as shown in FIG. 5. The end regions of the outer limbs of the second leaf member 44 are formed with downwardly pointing knife edges which engage in the upwardly open V grooves 45 of the first leaf member 43, and the end of the central limb of the second leaf member 44, which acts as a "C" type spring, is formed with an upwardly pointing knife edge which engages with the downwardly open V groove 46 of the first leaf member 43 and biases the outer limb knife edges into the grooves 45. It should be noted that the terms upwardly and downwardly as used herein are used merely in the sense of directions shown in FIGS. 5 and 6.

The first leaf member 43 is provided with tangs 47 which engage in openings 48 in the cap member 14 whereby the movement of the tape 13 relative to the beam 12 is transmitted to the actuator 35. The first leaf member 43 also acts to tension the tape 13 via the cap member 14. The second leaf member 44 is moved away from or towards the first leaf member 43 with a snap-action when the actuator geometry goes "over-centre", in either direction in response to movement of the tangs 47 of the first leaf member 43. The principal of over-centre microswitch mechanisms is well known in the art and will not therefore be described in detail here.

The lower end of the second leaf member 44 is engaged by a push or pull rod constituted by a slotted projection 49 formed on a tongue 51 of the leaf spring member 36 which carries the movable switch contact 37. Thus the movement of the second leaf member 44 of the actuator 35 is transmitted to the movable contact 37. It will be seen in FIG. 5 that the engagement slot 50 has clearance with respect to the second leaf member 44 so as to allow the latter to impart an impact to the projection 49 when it snaps away from the first leaf member 43. This helps to break any micro-welding at the contacts 37,41 during opening. A tongue 52 raised on the tab plate 38 acts as a back stop for the contact carrying tongue 51 when the contacts 37,41 are open.

Turning to the "hot hob" microswitch assembly 33, this comprises a two part snap-action actuator 53 which is of the same construction as actuator 35 except that the movable leaf member 54 now carries a contact 55.

Tangs 56 are formed at the tops of the outer limbs of the fixed leaf member 57 for engagement in apertures 58 in the cap 14.

A fixed contact 59 is provided on tab plate 60 which has tabs 61 for connection into a neon circuit. A generally triangular tab plate 62, having tabs 63, (FIG. 2) for connection to the neon circuit, is in intimate contact with the actuator 53. Insulators 34 electrically isolate the other components from each other. The tab plate 62 also has a threaded hole 64 to receive calibrating screw 27 which acts on the central limb of the fixed leaf member of the actuator 53. This varies the geometry of the actuator and thus the point at which the contact carrying leaf member 54 snaps away from or towards the fixed leaf member 57 to open or close the contacts.

The actuator 53 is set so as to keep the movable contact 55 displaced from the fixed contact 59 until a predetermined temperature of the hob top 2 is reached.

The operation of the device will now be described. When the hob top 2 is at room temperature switch unit 11 will be in the condition as shown in FIG. 5, with the power contacts 37,41 closed and the 'hot hob' contacts 55,59 open. The tape 13 is placed in tension by the microswitch actuators 35,53 such that as the hob top 2 heats up, and this is sensed by the tape 13, the latter expands with respect to the beam 12 and this expansion through the cap 14 and tangs 47,56, causes movement of the upper ends of the actuators 35,53. The tension in the tape 13 is set initially by a screw 65 provided on the adjustment member 15. This varies the initial deflection of the upper parts of the actuators 35,53 and so establishes an initial geometry within each, which is chosen so that the actuators 35,53 snap open at the desired temperatures, as the geometry of the actuators 35,53 change by virtue of expansion of the tape 13. A second calibration screw 27 acts as an additional means for calibrating the hot hob actuator 53.

Thus, when the heating elements 4 is switched on, tape 13 expands and cap 14 slides to the left (in the sense of FIG. 5) on the beam 12. When the temperature of the hob top as sensed by the tape reaches approximately 60° C., the hot hob actuator 53 snaps open to close the contacts 55,59 and causes a neon indicator to light to indicate the hob top is too hot to touch. At this point, the main contacts 37,41 are still closed, so that the heater element 4 continues to operate, heating hob top 2. Should the temperature of the hob top 2 reached a predetermined maximum say 650° C., the cap 14 will by then have just moved sufficiently to cause the cut-out actuator 35 to snap open, to break the contacts 37,41 via the leaf spring member 36, to cut the power supply to the heating element to allow the hob to cool. When the hob top 2 has cooled sufficiently, the actuator 35 will snap shut again to allow the contacts 37,41 to close again, and restore the power supply to the heating element 4.

It will thus be seen that at least in its preferred embodiments, the present invention provides a temperature limiting control in which a high expansion tape which senses the temperature of the top of a cooking appliance can be placed closely adjacent to the top by virtue of a ceramic beam, which provides a reference member, and the switch unit being arranged below the tape. The ceramic beam also shields the tape from a heating element situated below the control.

While a specific embodiment of the invention has been described, it will be apparent to persons skilled in the art that many modifications may be made which fall within the scope of the invention. For example although an advantageous form of microswitch unit has been described above, simpler, conventional microswitches could be used. For simplicity of construction, the movable contact of the temperature limiting microswitch may equally be directly mounted on the microswitch leaf member, rather than on a remote member. Also, while the reference member is shown in the preferred embodiment as being only slightly wider than the expansion member, it has been found that particularly good results are obtained if it is substantially wider than the expansion member. Typical widths of the reference and expansion members may be 5 and 2 mm respectively.

We claim:

1. A temperature limiting control for a cooking appliance having a heat transmitting top, including switch means and a temperature sensor comprising an elongate expansion member and an elongate reference member, the expansion member having a relatively high coefficient of thermal expansion as compared with that of the reference member, the relative movement of said members, in use, opening contacts of said switch means when a predetermined limit temperature is sensed, said switch means and said elongate reference member lying wholly or substantially to one side of said expansion member whereby, in use, the expansion member can be positioned in contact with or closely adjacent to the undersurface of the appliance top.

2. A control as claimed in claim 1 wherein said reference member lies wholly to one side of the expansion member.

3. A control as claimed in claim 1 wherein said reference member is opaque to infra red or other heating frequencies.

4. A control as claimed in claim 1 wherein said expansion member is flexible.

5. A control as claimed in claim 1 wherein said expansion member is in the form of a tape or strip.

6. A control as claimed in claim 1 wherein said expansion member comprises sections of lower thermal expansion relative to the remainder of the member.

7. A control as claimed in claim 1 wherein said expansion member is tensioned against the reference member.

8. A control as claimed in claim 7 wherein one end of the expansion member is fixed with respect to the reference member and biasing means is provided at the other end of the expansion member.

9. A control as claimed in claim 8 wherein the biasing means is provided in the switch means.

10. A control as claimed in claim 7 wherein means are provided for initially adjusting and setting the tension in the expansion member.

11. A control as claimed in claim 1 wherein said switch means comprises a snap-action switch.

12. A control as claimed in claim 1 wherein said switch is a microswitch.

13. A control as claimed in claim 12 wherein said microswitch is an over-centre 'C' type microswitch.

14. A control as claimed in claim 12 wherein said switch means is mounted in a housing which is fixed with respect to one end of the reference member.

15. A control as claimed in claim 14 wherein said expansion member is coupled to a microswitch member which acts as biasing means for tensioning the expansion member.

16. A control as claimed in claim 12 wherein said expansion member acts on a movable member within said microswitch, and a movable switch contact is provided remotely from said movable member which moves said contact through a push or pull rod.

17. A control as claimed in claim 16 wherein said movable member, said movable switch contact and said push or pull rod are so arranged that when said movable member operates to open said movable contact, said movable contact is subjected to an impact force.

18. A control as claimed in claim 1 further comprising a further set of contacts which close at a lower temperature than that at which the first contacts are opened, for activating a neon lamp or other warning device.

* * * * *